US012336573B2

(12) United States Patent
Champlin et al.

(10) Patent No.: US 12,336,573 B2
(45) Date of Patent: Jun. 24, 2025

(54) SLEEPSUIT FOR CHILDREN

(71) Applicants: Michele Champlin, Portland, OR (US); Rita Maureen Faust, Portland, OR (US)

(72) Inventors: Michele Champlin, Portland, OR (US); Rita Maureen Faust, Portland, OR (US)

( * ) Notice: Subject to any disclaimer, the term of this patent is extended or adjusted under 35 U.S.C. 154(b) by 0 days.

(21) Appl. No.: 18/432,604

(22) Filed: Feb. 5, 2024

(65) Prior Publication Data

US 2024/0172809 A1 May 30, 2024

Related U.S. Application Data

(63) Continuation-in-part of application No. 17/499,704, filed on Oct. 12, 2021, now abandoned.

(60) Provisional application No. 63/130,588, filed on Dec. 24, 2020.

(51) Int. Cl.
*A41B 13/06* (2006.01)

(52) U.S. Cl.
CPC ..... *A41B 13/06* (2013.01)

(58) Field of Classification Search
CPC ..... A41B 13/06; A41B 13/065; A41D 10/00
See application file for complete search history.

(56) References Cited

U.S. PATENT DOCUMENTS

| | | | | |
|---|---|---|---|---|
| 6,557,176 | B2 * | 5/2003 | Franco-Sion | A63B 21/065 2/102 |
| 6,692,413 | B1 * | 2/2004 | Greenberg | A63B 21/4001 2/108 |
| 7,870,623 | B2 * | 1/2011 | Judd | A63B 21/4007 5/655.4 |
| 8,215,773 | B2 * | 7/2012 | Gibson-Horn | A63B 26/003 351/203 |
| 8,863,329 | B2 * | 10/2014 | Gangan | A41B 13/06 5/655 |
| 8,943,615 | B2 * | 2/2015 | Howard | A41B 13/08 2/111 |
| 10,322,309 | B2 * | 6/2019 | Feldman | A61F 5/02 |
| 10,966,477 | B2 * | 4/2021 | Baker | A41D 27/24 |
| 10,974,018 | B2 * | 4/2021 | Pacheco | A47G 9/007 |
| 11,013,884 | B2 * | 5/2021 | Russin, Sr. | B32B 27/306 |
| 11,045,681 | B2 * | 6/2021 | Gineris | A63B 21/065 |
| D923,967 | S * | 7/2021 | Robertson | D6/598 |
| 11,051,639 | B1 * | 7/2021 | Nagy | A61M 21/02 |
| 11,052,219 | B2 * | 7/2021 | Figures | A61F 5/37 |
| 11,147,319 | B2 * | 10/2021 | Karp | A47D 15/008 |
| D952,291 | S * | 5/2022 | Enuganti | D2/719 |
| 11,357,268 | B2 * | 6/2022 | Krawchuk | A41B 13/005 |
| 11,490,663 | B2 * | 11/2022 | Karp | A47G 9/083 |

(Continued)

*Primary Examiner* — Alissa L Hoey
(74) *Attorney, Agent, or Firm* — Barry Choobin; Patent 360

(57) ABSTRACT

A sleepsuit for children having a front side and a rear side. The front side is heavier than the rear side. The front is divided into a top portion; a middle portion; and a lower portion. The middle portion is heavier than the top portion, and the top portion is heavier than the lower portion. The top portion is divided into consecutive four rows, wherein the first three rows are of equal heights, and the fourth row which is adjacent to the middle portion has a height larger than that of the first three rows. The middle portion can be divided into five rows.

3 Claims, 3 Drawing Sheets

(56) References Cited

U.S. PATENT DOCUMENTS 11,617,400 B2 * 4/2023 Gangan ..... A41D 11/00 2/69.5
11,641,958 B2 * 5/2023 Robertson ..... A47G 9/0207 5/486
D996,092 S * 8/2023 Bamberg ..... D6/602
11,832,656 B2 * 12/2023 Shekhani ..... A41B 13/08
11,889,873 B2 * 2/2024 Williams ..... A41B 13/06
2006/0064794 A1 * 3/2006 Howard ..... A41B 13/065 2/69
2008/0005824 A1 * 1/2008 Seckinger ..... A41B 13/00 2/80
2013/0139290 A1 * 6/2013 Barski ..... A41B 13/06 2/69.5
2014/0082819 A1 * 3/2014 Dunn ..... A41B 13/005 40/299.01
2014/0082821 A1 * 3/2014 Dunn ..... G09F 3/00 2/80
2015/0335853 A1 * 11/2015 Orewiler ..... A61F 5/50 128/869
2018/0035832 A1 * 2/2018 Ureten ..... A61M 21/02
2018/0228224 A1 * 8/2018 Radcliffe ..... A63B 67/06
2018/0326175 A1 * 11/2018 Figures ..... A61F 5/3723
2018/0332902 A1 * 11/2018 Damir ..... A41B 13/065
2019/0021525 A1 * 1/2019 Hamm ..... B32B 7/08
2019/0069609 A1 * 3/2019 Blackburn ..... A41B 13/06
2019/0274366 A1 * 9/2019 Hilton ..... A41D 10/00
2019/0274454 A1 * 9/2019 Bidhendi ..... A45C 13/10
2020/0093189 A1 * 3/2020 Shekhani ..... A41B 13/06
2020/0146370 A1 * 5/2020 Bortone ..... A41D 11/00
2020/0170424 A1 * 6/2020 Xu ..... A47G 9/0223
2020/0196685 A1 * 6/2020 Williams ..... A41B 13/06
2021/0007420 A1 * 1/2021 Gangan ..... A41B 13/06
2021/0022414 A1 * 1/2021 Shekhani ..... A41B 13/08
2022/0125138 A1 * 4/2022 Martinez ..... A41D 15/005
2022/0175061 A1 * 6/2022 Bill ..... A41D 31/305
2023/0077610 A1 * 3/2023 Williams ..... A41D 11/00 2/69.5

* cited by examiner

SLEEPSUIT FOR CHILDREN

CROSS-REFERENCE TO RELATED APPLICATIONS

This application is a continuation-in-part for a U.S. patent application Ser. No. 17/499,704 filed on Oct. 12, 2021, which is incorporated herein by reference in its entirety.

FIELD OF INVENTION

The present invention relates to garments for children. More particularly, the present invention relates to a wearable sleepsuit for children having one side that contains weighted compartments.

BACKGROUND

Lack of sleep can adversely affect the health and development of a young child and can also indirectly affect every member of a family. The learned ability to self-soothe is a developmental milestone that cannot be rushed, and for some babies, this means that they struggle more than others when trying to sleep independently. With a significant number of studies suggesting the positive effects of physical touch on an infant, it is evident that subtle pressure produces a measurable impact that assists babies in reducing stress, calming down, and sleeping better. Cradling an infant throughout a night or duration of a nap is less than ideal and can even lead to compromising safe sleep practices. Parents are left with a long unfulfilled desire for a solution that can calm their babies and help them to sleep.

Weighted blankets have gained significant popularity among older children and adults alike for their ability to reduce cortisol levels while inducing the release of serotonin. The result is a calmer, relaxed sensation with promising effects on improved sleep; helping those fall asleep and have a good healthy long sleep. Similarly, it has been proposed by early studies that the weighted blankets provide a sensory stimulus to the babies which similarly calms them and can improve sleep, as would be the result of uninterrupted touch or cradling from a caregiver or parent.

Weighted blankets are heavier than normal blankets which may include beads, rice, and the like for additional weight. The design or weight distribution is an important factor for the effectiveness of the weighted blankets. Thus, a need is always there to optimize the known products or create new products for better comfort and advantages.

SUMMARY OF THE INVENTION

The following presents a simplified summary of one or more embodiments of the present invention to provide a basic understanding of such embodiments. This summary is not an extensive overview of all contemplated embodiments and is intended to neither identify key or critical elements of all embodiments nor delineate the scope of any or all embodiments. Its sole purpose is to present some concepts of one or more embodiments in a simplified form as a prelude to the more detailed description that is presented later.

The principal object of the present invention is therefore directed to a sleepsuit with an optimized weight distribution that exerts a soothing weight across the child's body.

Another object of the present invention is that the sleepsuit helps to calm a child by increasing the release of serotonin and melatonin in the body, while decreasing cortisol levels. The disclosed sleeping suit, by simulating a child being held or swaddled, allows a child to have a good sleep which is essential for physical and mental health of the child.

In one aspect, disclosed is a sleepsuit for a child comprising a front side; and a rear side, wherein the front side is heavier than the rear side. The front side comprises a top portion; a middle portion; and a lower portion. The middle portion is heavier than the top portion, the top portion is heavier than the lower portion. The top portion is divided into consecutive four rows, wherein the first three rows are of equal heights, and the fourth row which is adjacent to the middle portion is of a height larger than that of the row of the first three rows. The front side comprises added weight that is distributed by forming rows and columns in a manner to exert desired pressure on the child's body. The middle portion is divided into traversing five rows of equal heights. The lower portion comprises one row. Each of the first three rows of the top portion is of a height that is one-half height of the row of the middle portion. The fourth row of the top portion is of a height that is three-fourth height of the row of the middle portion. The maximum height of the lower portion is equal to the height of the fourth row of the top portion. The sleepsuit further comprises a neck opening and a pair of arms openings. The sleepsuit further comprises a yoke portion extending between the front side and the rear side at a top of the sleepsuit.

These and other objects and advantages of the embodiments herein and the summary will become readily apparent from the following detailed description taken in conjunction with the accompanying drawings.

BRIEF DESCRIPTION OF THE DRAWINGS

The accompanying figures, which are incorporated herein, form part of the specification and illustrate embodiments of the present invention. Together with the description, the figures further explain the principles of the present invention and to enable a person skilled in the relevant arts to make and use the invention.

DETAILED DESCRIPTION

Figure 1:
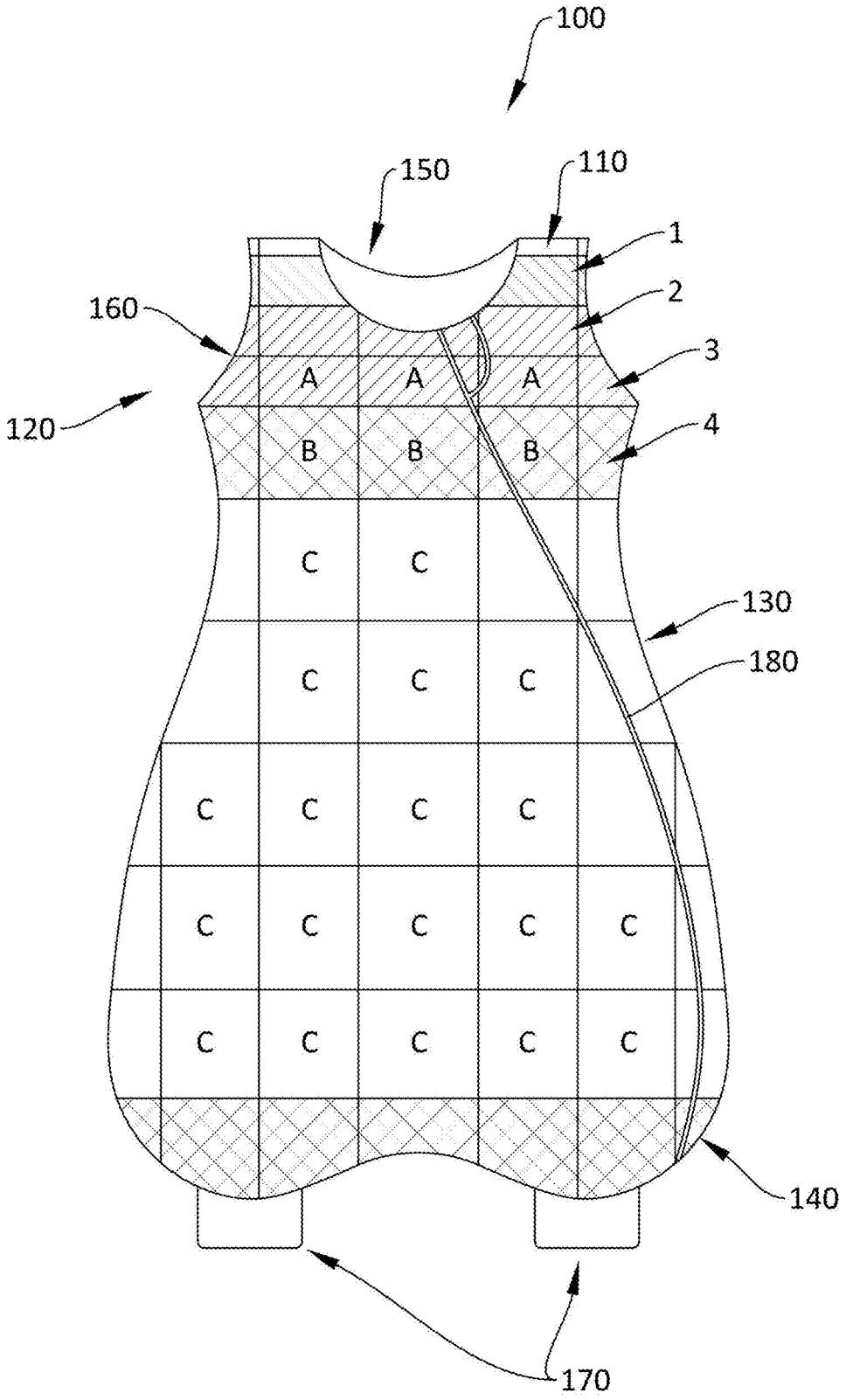
FIG. 1 is a perspective view of a sleepsuit, according to an exemplary embodiment of the present invention.

Subject matter will now be described more fully hereinafter with reference to the accompanying drawings, which form a part hereof, and which show, by way of illustration, specific exemplary embodiments. Subject matter may, however, be embodied in a variety of different forms and, therefore, covered or claimed subject matter is intended to be construed as not being limited to any exemplary embodiments set forth herein; exemplary embodiments are provided merely to be illustrative. Likewise, a reasonably broad scope for claimed or covered subject matter is intended. Among other things, for example, the subject matter may be embodied as methods, devices, components, or systems. The following detailed description is, therefore, not intended to be taken in a limiting sense.

The word "exemplary" is used herein to mean "serving as an example, instance, or illustration." Any embodiment described herein as "exemplary" is not necessarily to be construed as preferred or advantageous over other embodiments. Likewise, the term "embodiments of the present invention" does not require that all embodiments of the invention include the discussed feature, advantage, or mode of operation.

The terminology used herein is for the purpose of describing particular embodiments only and is not intended to be limiting of embodiments of the invention. As used herein, the singular forms "a", "an" and "the" are intended to include the plural forms as well, unless the context clearly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

The following detailed description includes the best currently contemplated mode or modes of carrying out exemplary embodiments of the invention. The description is not to be taken in a limiting sense but is made merely for the purpose of illustrating the general principles of the invention, since the scope of the invention will be best defined by the allowed claims of any resulting patent.

Disclosed is a sleepsuit for children, and in particular for infants and toddlers of age up to 24 months that helps them to calm and sleep. The disclosed sleepsuit by exerting some optimized pressure/weight on the child's body helps them to fall asleep faster, easier than without the support of the suit. Moreover, the sleep is longer with very few disturbances, which is good for the overall development of the child. The disclosed sleepsuit includes the front side and a rear side. The rear side does not include any added weight. The front side includes added weights, which are gradually distributed on the front side. This distribution of weight in the front side of the sleepsuit is a critical feature of the invention that helps the child to sleep better.

As shown in FIG. 1, the front side of the sleepsuit 100 can be divided into rows and columns. These rows and columns may help to distribute the weight in an optimized manner over the front side of the sleep suit. The rows and columns can be formed by stitching, wherein each cell formed by the rows and columns can include suitable weighted material.

The top portion of the sleepsuit can be a yoke portion 110, which may cover the top of child's shoulders. The yoke portion connects the front side and the rear side of the sleepsuit at the top of the sleeping suit. The yoke portion may be like the rear side in structure and does not include any added weights. The front side of the sleepsuit can be divided, for illustration, into a top portion 120, a middle portion 130, and a lower portion 140. The top portion is continuous with the yoke portion 110 and extends downwards. The middle portion extends between the top portion and the lower portion.

As shown in the drawing, the top portion includes four rows i.e., a first top row 1 (T1), a second top row 2 (T2), a third top row 3 (T3), and a fourth top row (T4), wherein first row of the top portion (T1) is adjacent to the yoke portion 110, and the fourth row of the top portion (T4) is adjacent to the middle portion. The middle portion 130 can be divided into five rows (M1-M5), wherein all five rows are of equal height. The lower portion 140 includes one row (L1).

Figure 3:
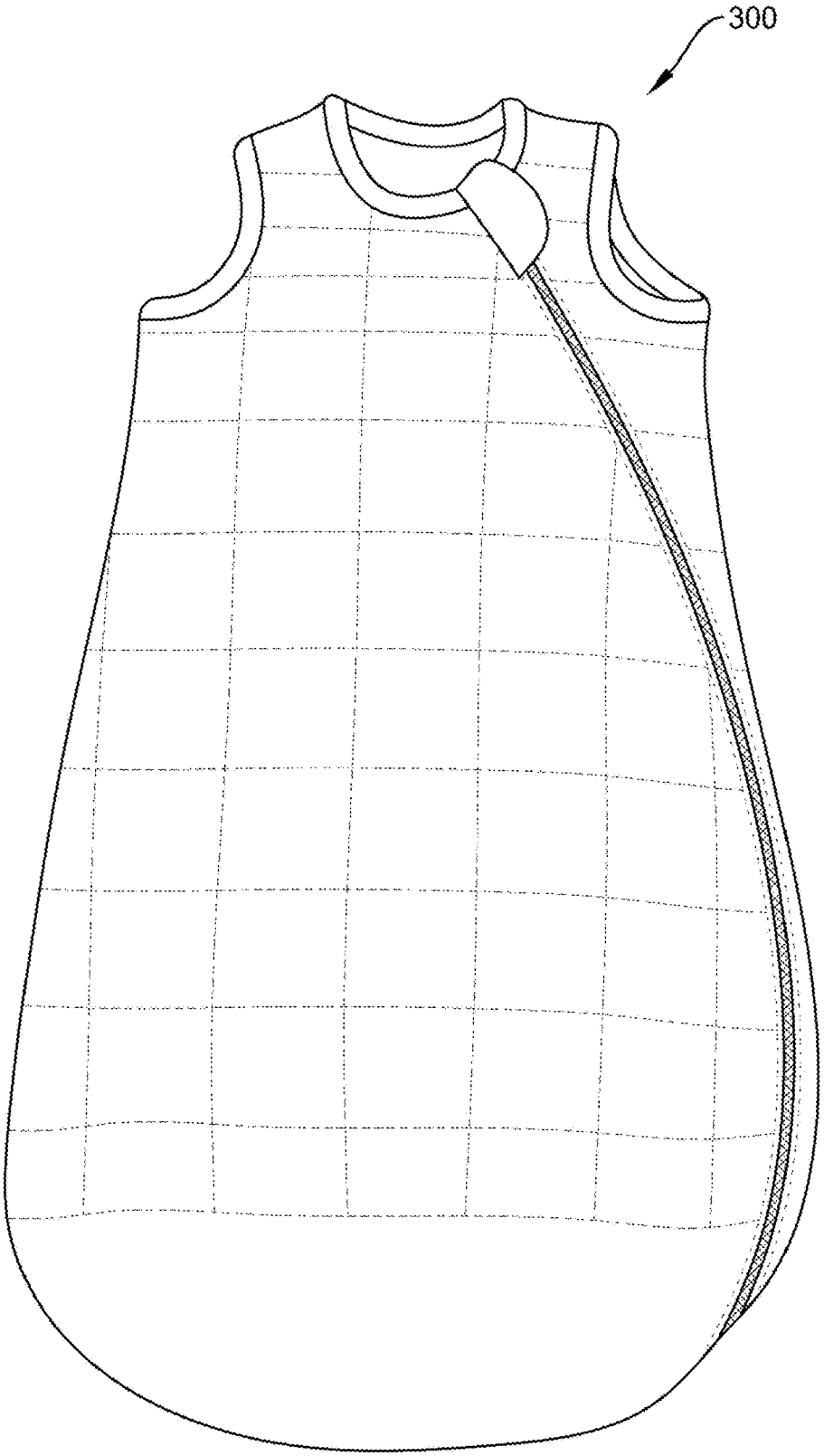
FIG. 3 shows another embodiment of the sleepsuit, according to an exemplary embodiment of the present invention.

The sleepsuit includes a neck opening 150 that extends within the yoke portion 110 and the first row of the top portion (T1) on the front side of the sleepsuit. The sleepsuit also includes two arm openings 160 that on the front side extend along the first, second, and the third rows of the top portion (T1-T3). The sleepsuit may also include two leg openings 170. However, the two lower leg openings can be optional. For example, FIG. 3 shows the sleepsuit 300 without the leg openings.

The top portion can cover substantially the chest of the child. The middle portion can substantially extend down closer to the lower shin area of the child. The lower portion can extend substantially up to the ankles of the child.

In one implementation, the disclosed sleepsuit can provide an all-over gradually weighted pressure across the child's body, starting with lighter weight/pressure by the top portion, heavier/pressure weight by the middle portion, and then lighter weight/pressure by the lower portion, with the purpose of more safely mimicking the human hold across the child's body. The disclosed sleepsuit 100 addresses the two important factors i.e., safety and care of child. The disclosed sleepsuit 100 fulfills a long desire of parents who know cradling their baby all night is neither a practical compromise nor a safe option.

In one implementation, the height of rows in the middle portion i.e., M1-M5 can be equal. The rows in the middle portion can be of equal heights. The height of the first three rows of the top portion (T1-T3) can be about one-half the height of the row in middle portion (M1) i.e., height of rows T1-T3 can be about one-half the height of the row M1. The fourth row of the top portion (T4) can be of a height about three-fourths of the height of row in the middle portion i.e., height of row T4 can be about three-fourths of the height of the row M1. Similarly, the maximum height of the one row in the lower portion (L1) can be about three-fourths of the height of row in the middle portion i.e., maximum height of row L1 can be about three-fourths of the height of the row M1.

In one implementation, the height of the rows in the middle portion can be about 2⅜ inches. The height of the rows T1-T3 can be about 1⅛ inches. The height of the rows T4 and L1 can be about 1¾ inches. In FIG. 1, row T3 may have perfect cells indicated by A, row T4 may have perfect cells indicated by B, and middle portion may have perfect cells indicated by C. The width of cells A, B, and C can be about 2.5 inches. Cell A can exert a weight of about 0.02-0.06 ounce/square inch. Cell B can exert a weight of about 0.03-0.07 ounce/square inch. Cells C can exert a weight of about 0.08-0.12 ounce/square inch.

FIG. 1 also shows a fastener 170 that extends from the neck opening and down towards the leg opening. The fastener 170 allows opening the front side of the sleepsuit 100 for putting the baby suit on the child's body. The fastener can be a zipper or spaced buttons.

The front side of the sleepsuit 100 may be heavier than the rear side because of added weight on the front side. Weight is gradually distributed on the front side, as described above, so that more pressure can be exerted on certain parts of the child's body while less pressure on sensitive areas, such as neck/shoulders of the infant. The unique weight distribution of the disclosed sleepsuit 100 can support all movement efforts of the children ensuring that the children can safely lift their head/chest and roll back over as desired.

The above-described gradual weight distribution in the disclosed sleepsuit 100 can be adapted to the age and weight of a child, to ensure that the sleepsuit 100 is safe and effective to use. The gradual weight distribution of the disclosed sleepsuit 100 can naturally soothe a baby with an overall pressure sensation to mimic the child being cuddled.

Figure 2:
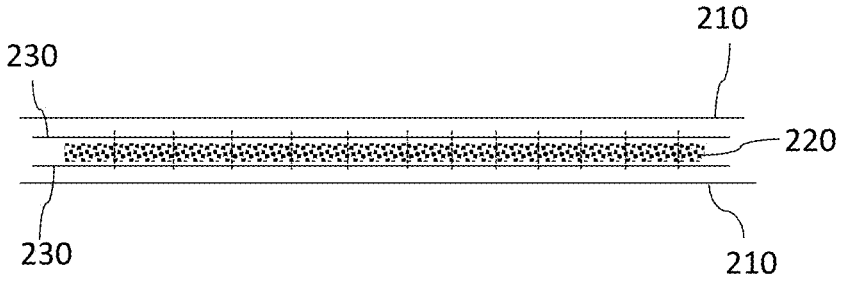
FIG. 2 is a sectional view of the front side of the sleepsuit, according to an exemplary embodiment of the present invention.

Referring to FIG. 2, which shows a section of the front side of the sleepsuit 100. The front side of the sleepsuit 100 can be multilayered. The multilayered front side can be breathable that allows the sweat to evaporate, and so the risk of overheating is eliminated. The inner two layers of the multilayered front side can be stitched/secured to create several compartments/cells. A weighted amount of granular material, such as sand, beads, seeds, and the like can be contained in the compartments for the gradient weight distribution of the front side. The different materials can be used for weight distribution. For example, beads of different weight density can be used for the weight distribution. Moreover, the weight distribution can also be achieved by having smaller compartments. The granular material can be preferably nontoxic and child safe.

FIG. 2 shows granular material 220 sandwiched between the two layers 210, wherein the several traversing lines spaced across the length of the granular layer illustrates the compartments. The compartments and sub-compartments may form a gradient array of weight that provides gentle, even pressure on the front-side of the infant's body. The front side can further have outer layers 230 reinforcing the inner layers 220. The material of the outer layers 230 can be child friendly. In one aspect, the overall weight of the front side of the sleepsuit 100 can be in a range of 5 to 20 percent of a weight of a child that wears the disclosed sleepsuit 100. Preferably, the front side can weigh up to 10-20 percent of the weight of the child. Preferably, the front side can weigh up to 10 percent of the weight of the child.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above-described embodiment, method, and examples, but by all embodiments and methods within the scope and spirit of the invention as claimed.

What is claimed is:

1. A sleepsuit for a child comprising:

a front side; and a rear side, wherein the front side is heavier than the rear side, the front side comprises:

a top portion;

a middle portion comprising a plurality of rows; and a lower portion comprising a lower row;

wherein the middle portion is heavier than the top portion, the top portion is heavier than the lower portion, wherein the top portion comprises consecutive four rows, a first row, a second row, a third row, and a fourth row, wherein the first row has a middle part, wherein the first row excluding the middle part, the second row, and the third row are of equal heights, and the fourth row which is adjacent to the middle portion is of a height larger than that of the first row of the top portion, wherein each row of the top portion, the middle portion, and the lower portion comprises weighting granular material that is distributed by forming columns in each row of the top portion, the middle portion, and the lower portion in a manner to exert desired pressure on a body of the child, wherein the plurality of rows in the middle portion comprises traversing five rows of equal heights, the traversing five rows comprises a first middle row, middle row is adjacent to the fourth row of the top portion, wherein the first row of the top portion is of a height that is one-half a height of the first middle row, wherein the fourth row of the top portion is of a height that is three-fourths of the height of the first middle row, wherein a maximum height of the lower row is equal to the height of the fourth row of the top portion; and wherein the sleepsuit further comprises a neck opening and a pair of arms openings, wherein the neck opening extends within a yoke portion and the middle part in the first row of the top portion, wherein each of the pair of arm openings extends along the first, second, and third rows of the top portion, wherein the yoke portion is continuous with the top portion.

2. The sleepsuit according to claim 1, wherein the yoke portion extends between the front side and the rear side at a top of the sleepsuit.

3. The sleepsuit according to claim 2, wherein the sleepsuit further comprises a zipper extending between the neck opening and a leg opening.

* * * * *